US006213232B1

(12) United States Patent
Peetz

(10) Patent No.: US 6,213,232 B1
(45) Date of Patent: Apr. 10, 2001

(54) DRILLING TOOL HELICAL SHANK FORMED FROM A POLYGONAL PROFILE BAR

(75) Inventor: Wolfgang Peetz, Fronreute-Blitzenreute (DE)

(73) Assignee: Hawera Probst GmbH, Ravensburg (DE)

( * ) Notice: Subject to any disclaimer, the term of this patent is extended or adjusted under 35 U.S.C. 154(b) by 0 days.

(21) Appl. No.: 09/424,502

(22) PCT Filed: May 15, 1998

(86) PCT No.: PCT/DE98/01376

§ 371 Date: Nov. 24, 1999

§ 102(e) Date: Nov. 24, 1999

(87) PCT Pub. No.: WO98/54435

PCT Pub. Date: Dec. 3, 1998

(30) Foreign Application Priority Data

May 30, 1997 (DE) ..... 197 22 519

(51) Int. Cl.[7] ..... E21B 10/44

(52) U.S. Cl. ..... 175/394; 175/416; 408/230

(58) Field of Search ..... 175/394, 416, 175/420.1, 323; 408/226, 229, 230

(56) References Cited

U.S. PATENT DOCUMENTS

| | | | | |
|---|---|---|---|---|
| 2,773,672 | * | 12/1956 | Holmes et al. | 175/394 X |
| 4,749,051 | | 6/1988 | Larsson . | |
| 5,096,344 | * | 3/1992 | Fischer | 408/230 |

FOREIGN PATENT DOCUMENTS

| | | | | |
|---|---|---|---|---|
| 331 438 | | 9/1958 | (CH) . | |
| 887 631 | | 8/1953 | (DE) . | |
| 2 045 896 | | 3/1972 | (DE) . | |
| 43 06 981 | | 9/1994 | (DE) . | |
| 0 361 189 | | 4/1990 | (EP) . | |
| 628665 | * | 10/1927 | (FR) | 175/394 |
| 2035158 | * | 6/1980 | (GB) | 175/394 |

* cited by examiner

*Primary Examiner*—Frank Tsay
(74) *Attorney, Agent, or Firm*—Morgan, Lewis & Bockius LLP

(57) ABSTRACT

A drilling tool, in particular a rock drill, is proposed, which is formed from a drill head, a clamping shank and a helical shank which is located between them. In order to produce a cost-effective drilling tool, the initial material used is a polygonal profile which is provided with a conveying helix groove in the region of the helical shank.

20 Claims, 3 Drawing Sheets

DRILLING TOOL HELICAL SHANK FORMED FROM A POLYGONAL PROFILE BAR

The invention relates to a drilling tool, in particular a rock drill according to the preamble of claim 1.

PRIOR ART

Drilling tools and, in particular, rock drills consist generally of, a drilling head fitted with a carbide cutting plate, of a helical shank with a spiral conveying helix for drilling dust or drillings and of a clamping shank for inserting the drilling tool into a drive machine.

The spiral conveying helix of a rock drill is produced generally by cutting away chips, if appropriate also without cutting (for example, by rolling rollers), in order to introduce the conveying helix grooves into the generally cylindrical initial material. In this case, where rock drills are concerned, the main function of the conveying helix is to convey the material released by the carbide cutter, that is to say the drilling dust or else drillings, out of the drillhole. Cylindrical initial materials of this kind are available in a wide variety of dimensions, so that a narrow graduation of drilling diameters can be produced.

The known drilling tools are fundamentally based on the fact that the helical shank has a cylindrical initial cross section, since the introduction of one or more conveying helix grooves gives rise to continuous ridges of the conveying helix groove which lie on an outer cylindrical surface. This is intended to ensure that drilling proceeds quietly or with little vibration, with the conveying helix being guided accurately along the conveying helix ridges.

OBJECT OF THE INVENTION

The object on which the invention is based is to provide a drilling tool and, in particular, a rock drill, which has improved handling properties, as compared with conventional drilling tools, along with a drilling capacity which is at least equal to that of these drilling tools.

SOLUTION FOR ACHIEVING THE OBJECT AND ADVANTAGES OF THE INVENTION

Proceeding from a rock drill of the type initially designated, this object is achieved, according to the invention, by means of the defining features of claim 1.

Advantageous developments and improvements of the drilling tool specified in the main claim are possible by virtue of the features listed in the subclaims.

The invention is based on the knowledge that an increased drilling capacity can be achieved by reducing the frictional losses and increasing the conveying capacity, in that the cross section of the initial material for the conveying helix is not circular, but is replaced by a preferably symmetric polygonal profile. When a conveying helix is cut into such a polygonal profile, the remaining ridges are composed of surface portions which are lined up with one another and which, in turn, form additional pockets for transporting the drilling dust. Markedly reduced wall friction is thereby established, since the ridge of the conveying helix does not have any surface contact, but at most linear contact. Furthermore, due to the alternately successive longitudinal edges of the surface portions on the ridges of the conveying helix, a kind of scraper effect is established, which likewise leads to a positive drilling result. Moreover, an improved conveying capacity for the drilling dust is established, since the longitudinal edges on the ridges act as an additional conveying edge or pushing edge which also pushes the drilling dust into the deeper grooves, so that jamming in the region of the ridges is avoided. The flattening of the surface portions on the ridges also increases the conveying volume during the drilling operation.

In a particularly advantageous version of the invention, the clamping shank is also designed as a polygonal profile in the manner of a polygonal course, that is to say the complete drilling tool consists of the same polygonal profile, in which conveying helix grooves are introduced by cutting away chips. Particularly when received into a commercially available three-jaw chuck of a percussion drilling machine or the like, the polygonal clamping shank brings about a positive takeup, so that spinning of the drilling tool, particularly also in the case of jaw chucks having a relatively low clamping force, for example due to wear or the like, is virtually ruled out.

A multiplicity of drill sizes can therefore be produced in various dimensions by means of commercially available polygonal profile bars merely by the introduction of conveying helix grooves, the clamping shank affording the advantage of positive takeup in the multijaw chuck. For this purpose, the polygonal profile bar must have, at least in the region of the clamping shank, clamping surfaces arranged so as to be offset by 120°.

In a particular refinement of the invention, the clamping shank may also have a cylindrical cross section, in order to adapt the clamping shank to the drill receptacle, for example in hammer drilling machines. For this purpose, extruded blanks are preferably used, which are provided in the region of the conveying helix as a polygonal profile and in the region of the clamping shank with a cylindrical profile. The clamping shank can then be adapted to the respective conditions for use, for example in hammer drilling machines, whilst the helical shank having the conveying helix described is produced by cutting away chips.

In a particular design, such an embodiment may be produced as an extruded blank or forged blank, so as to allow for any desired diameter variants and cross-sectional forms in the initial shapes with a polygonal profile in the region of the helical shank and with a, for example, cylindrical profile in the region of the clamping shank.

The helical shank and clamping shank may, however, also be connected to one another in their respective shapes by means of a suitable welding method (for example friction welding method, resistance welding method and the like).

Further particulars and advantages of the invention are explained in more detail in the following exemplary embodiments with reference to the drawings, in which.

Figure 2C:
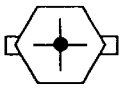
FIG. 2 shows a side view of the rock drill according to FIG. 1.
Figure 2:
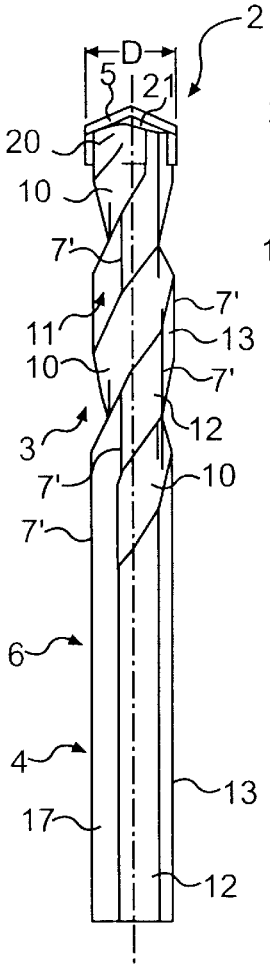
Figure 2B:
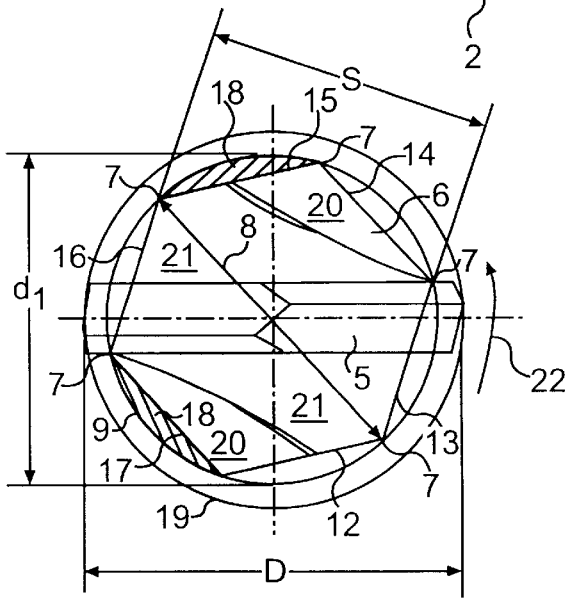
Figure 2A:
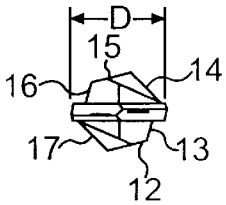

FIG. 2*a* shows a top view of the rock drill according to FIG. 2;

FIG. 2*b* shows an enlarged illustration of FIG. 2*a;*

Figure 3:
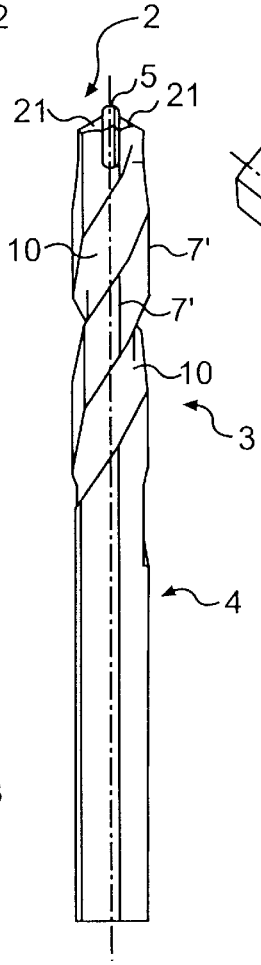
Figure 5:
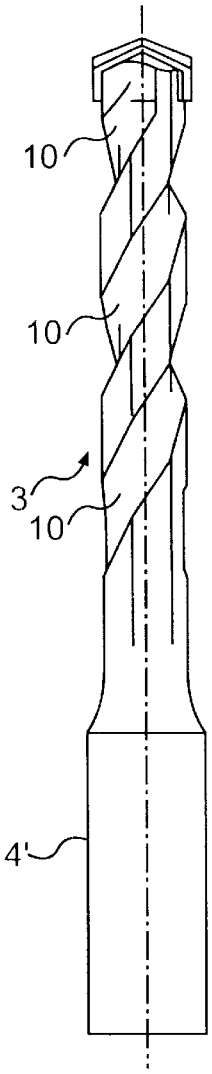
Figure 4:
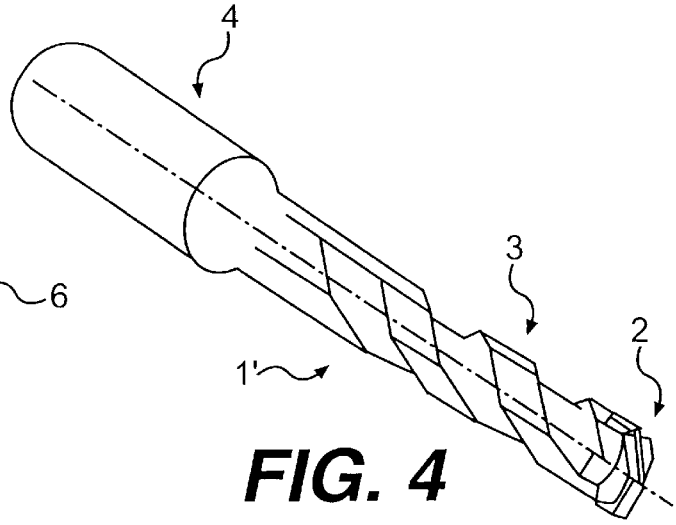
Figure 5B:
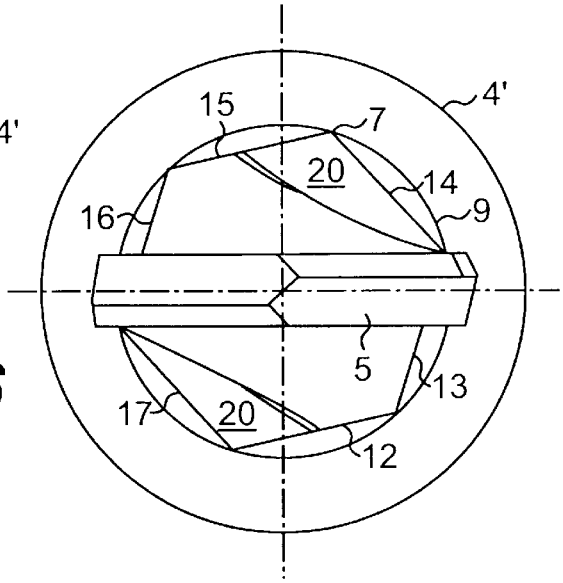
Figure 5A:
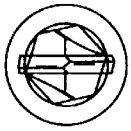

FIG. 2*c* shows a view of the lower end of the rock drill according to FIG. 2;

FIG. 3 shows the rock drill according to FIG. 2, rotated through 90°, that is to say its side view;

FIG. 4 shows a perspective of a further variant of a rock drill;

FIG. 5 shows a side view of the rock drill according to FIG. 4;

FIG. 5*a* shows a top view of the rock drill according to FIG. 5;

FIG. 5*b* shows an enlarged illustration according to FIG. 5*a;*

Figure 6:
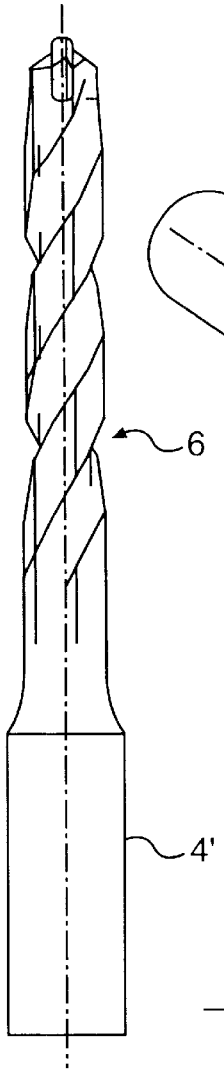
Figure 7:
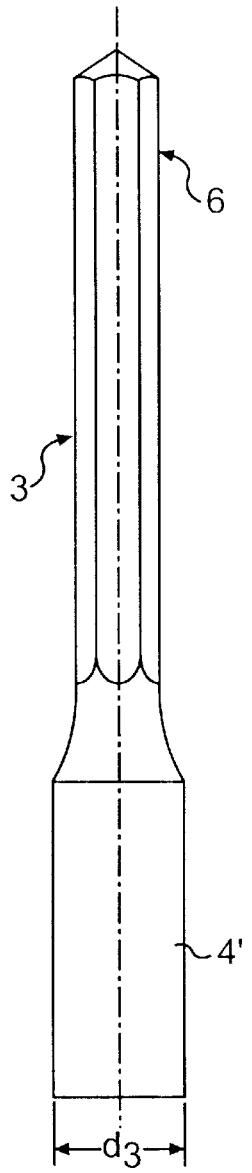
Figure 7A:
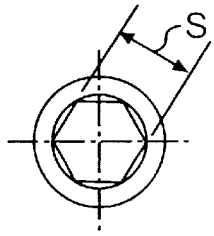

FIG. 6 shows a side view of the rock drill according to FIG. 5;

FIG. 7 shows a side view of an initial blank for producing the tool according FIGS. 5 to 6;

FIG. 7*a* shows a top view of the blank according to FIG. 7; and

Figure 8:
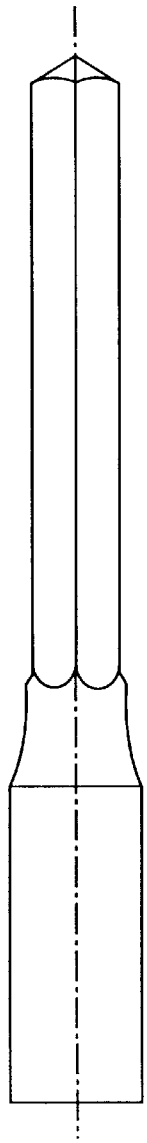

FIG. 8 shows a side view of the blank according to FIG. 7.

DESCRIPTION OF THE EXEMPLARY EMBODIMENTS

Figure 1:
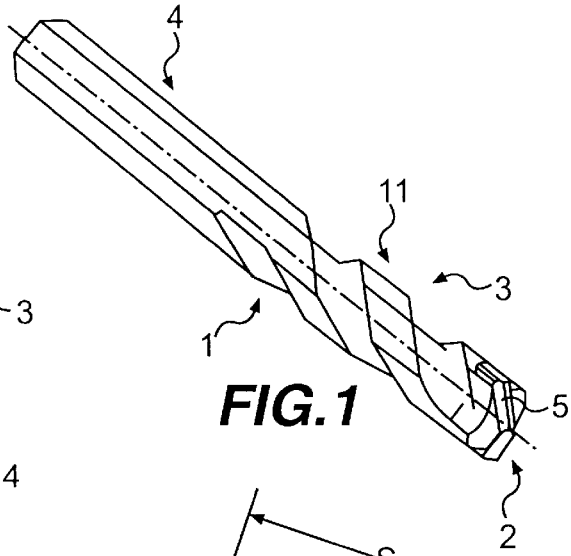
FIG. 1 shows a perspective view of a rock drill with a hexagonal cross section.

The first exemplary embodiment illustrated in FIGS. 1 to 3 shows a rock drill 1 with a drill head 2, a helical shank 3 and a clamping shank 4. The drill head 2 has a commercially available rooflike carbide cutting blade 5 which with its outside diameter D forms the nominal diameter of the drill.

In the exemplary embodiment according to FIG. 1 to 3, the initial material used for producing the rock drill 1 is a commercially available hexagonal steel, such as is available, for example, in a very wide variety of dimensions in DIN 176, DIN 1015 or DIN 59110. The width across flats s serves, here, for determining the respective dimensions.

The diagonal 8 drawn through the respective corner points 7 of the hexagonal profile 6 has a length of $d_1$ which corresponds to the diameter of the circumscribed circle 9 through the corner points 7.

According to the invention, a conveying helix groove 10 is introduced by cutting away chips into such a hexagonal profile 6 extending over the clamping shank and the helical shank, the polygonal profile being maintained in full in the region of the ridges 11. The ridges are consequently composed of plane surface portions 12 to 17 which conventionally form the wrench surfaces of the hexagonal profile 6. These surface portions 12 to 17 are interrupted by vertical longitudinal edges 7' which run through the corner points 7 of the hexagonal cross section. This gives rise, in addition to the conveying helix grooves 10, to chip pockets 18 which are in the form of a segment of a circle and which are arranged between the surface portions 12 to 17 and the circumscribed circle 9 (see FIG. 2*b*) and form an additional conveying volume. The overall conveying volume is, of course, formed by the interspace between the circumscribed circle 19 having the nominal diameter D and the corresponding surface portions 12 to 17 as well as the conveying helix grooves 10.

The top view according to FIG. 2*b* shows, by-way of example, an entry region 20 into the conveying helix groove 10 located below it, that is to say the head support 21 for the carbide cutting plate 5 supports the latter in each case in an approximately V-shaped manner, as seen in a top view. The direction of rotation is identified here by the arrow 22.

As is also apparent from FIG. 2*b*, the carbide cutting plate 5 is inserted into the drill head 2 in such a way that two corner points 7 located opposite one another delimit the cutting plate 5 approximately on both sides.

In the drilling tool illustrated in FIGS. 1 to 3, therefore, the surface portions 12 to 17 run as wrench surfaces over the entire drilling tool and therefore form the characteristic conveying helix with flattened vertical surface portions which are interrupted by the respective conveying helix groove 10. Furthermore, the clamping shank possesses a form-fitting polygonal profile which is suitable, in particular, for rotation-proof insertion in a percussion drilling machine, for example with a three-jaw chuck.

An alternative embodiment of the invention is illustrated in FIGS. 4 to 6. Parts identical to those described with reference to FIGS. 1 to 3 are given the same reference symbols.

The rock drill 1' illustrated in FIGS. 4 to 6 therefore has, in turn, a drill head 2, a helical shank 3 and a clamping shank 4. The design of the helical shank 3 together with the drill head 2 is identical to the exemplary embodiment according to FIGS. 1 to 3. Only the clamping shank 4 is designed, for example, as a cylindrical clamping end 4'.

A profile bar, such as is illustrated in more detail in FIGS. 7 and 8, may serve as initial material for producing a drilling tool according to FIGS. 4 to 6. Such a profile may be produced by an extrusion method or a forging method jointly with a cylindrical clamping shank 4, in which case the cylindrical clamping shank 4 has, for example, a diameter $d_3$, such as is required for producing an SDS-plus clamping end of a hammer drilling machine. Once again, the hexagonal profile 6 is characterized by its width across flats s and is produced by a joint extrusion method or forging method together with a clamping shank.

In the exemplary embodiment according to FIGS. 4 and 5, the conveying helix grooves 10 are then, once again, introduced by a chip-cutting work method. Furthermore, the clamping end is adapted, as required, to the drill chuck of a hammer drilling machine. This may be, in particular, an SDS-plus clamping end.

In an alternative embodiment, the helical shank 3 and the cylindrical clamping shank 4', for example in the version according to FIGS. 4 to 6, may also be connected to one another by a suitable welding method.

The invention is not restricted to the exemplary embodiment illustrated and described. It also embraces, on the contrary, all developments within the ability of an average person skilled in the art within the scope of the patent claims.

What is claimed is:

1. A drilling tool, in particular a rock drill, with a drill head, a clamping shank and located therebetween. a helical shank in which a drilling dust groove is introduced, wherein at least an initial portion of the helical shank is formed from a polygonal profile bar of a symmetrical cross section, into which a conveying helix groove is additionally introduced by cutting away material from the polygonal profile bar.

2. The drilling tool as claimed in claim 1, wherein the clamping shank is formed from the same polygonal profile bar as the helical shank.

3. The drilling tool as claimed in claim 2, wherein the profile bar for forming the clamping shank or the helical shank consists of a symmetric polygonal profile, with at least three clamping surfaces which are capable of being clamped into a commercially available three-jaw chuck and which are arranged so as to be offset at an angle of rotation $\beta \approx 120°$.

4. The drilling tool as claimed in claim 1, wherein the polygonal profile bar for forming the clamping shank or the helical shank consists of a symmetric polygonal profile, with at least three clamping surfaces which are capable of being clamped into a commercially available three-jaw chuck and which are arranged so as to be offset at an angle of rotation $\beta \approx 120°$.

5. The drilling tool as claimed in claim 4, wherein the polygonal profile bar is formed from a commercially available polygonal profile bar, selected from a group consisting of a hexagonal profile bar, a quadrangular profile bar, or a triangular profile bar.

6. The drilling tool as claimed in claim 4, wherein the drill head is provided with a carbide cutting plate which is arranged symmetrically, in the cross section of the polygonal profile bar, and which, in side view, is rooflike in design.

7. The drilling tool as claimed in claim 4, wherein the clamping shank is connected to the helical shank via a welded joint.

8. The drilling tool as claimed in claim 4, wherein the clamping shank is designed as a hammer drill clamping shank.

9. The drilling tool as claimed in claim 1, wherein the polygonal profile bar is formed from a commercially available polygonal profile bar, selected from a group consisting of a hexagonal profile bar, a quadrangular profile bar, or a triangular profile bar.

10. The drilling tool as claimed in claim 9, wherein the drill head is provided with a carbide cutting plate which is arranged symmetrically, in the cross section of the polygonal profile bar, and which, in side view, is rooflike in design.

11. The drilling tool as claimed in claim 9, wherein an initial portion of the drilling tool consists of an extruded blank or forged blank, with a polygonal profile of polygon-like cross section at least in the region of the helical shank, and with a cylindrical or profiled clamping shank.

12. The drilling tool as claimed in claim 9, wherein the clamping shank is connected to the helical shank via a welded joint.

13. The drilling tool as claimed in claim 9, wherein the clamping shank is designed as a hammer drill clamping shank.

14. The drilling tool as claimed in claim 1, wherein the drill head is provided with a carbide cutting plate which is arranged symmetrically, in the cross section of the polygonal profile bar, and which, in side view, is rooflike in design.

15. The drilling tool as claimed in claim 14, wherein an initial portion of the drilling tool consists of an extruded blank or forged blank, with a polygonal profile of polygon-like cross section at least in the region of the helical shank, and with a cylindrical or profiled clamping shank.

16. The drilling tool as claimed in claim 1, wherein an initial portion of the drilling tool consists of an extruded blank or forged blank, with a polygonal profile of polygon-like cross section at least in the region of the helical shank, and with a cylindrical or profiled clamping shank.

17. The drilling tool as claimed in claim 16, wherein the clamping shank is connected to the helical shank via a welded joint.

18. The drilling tool as claimed in claim 1, wherein the clamping shank is connected to the helical shank via a welded joint.

19. The drilling tool as claimed in claim 18, wherein the clamping shank is designed as a hammer drill clamping shank.

20. The drilling tool as claimed in claim 1, wherein the clamping shank is designed as a hammer drill clamping shank.

* * * * *